US007913338B2

(12) United States Patent
Chapman

(10) Patent No.: US 7,913,338 B2
(45) Date of Patent: Mar. 29, 2011

(54) INFLATABLE PAD

(75) Inventor: Paul William Chapman, Bedfordshire (GB)

(73) Assignee: Huntleigh Technology Limited (GB)

( * ) Notice: Subject to any disclaimer, the term of this patent is extended or adjusted under 35 U.S.C. 154(b) by 97 days.

(21) Appl. No.: 10/559,691

(22) PCT Filed: Jun. 4, 2004

(86) PCT No.: PCT/GB2004/002362

§ 371 (c)(1),
(2), (4) Date: Apr. 21, 2006

(87) PCT Pub. No.: WO2004/108047

PCT Pub. Date: Dec. 16, 2004

(65) Prior Publication Data

US 2006/0253992 A1 Nov. 16, 2006

(30) Foreign Application Priority Data

Jun. 6, 2003 (GB) ..... 0313046.5

(51) Int. Cl.
*A61G 7/10* (2006.01)

(52) U.S. Cl. ..... 5/710; 5/655.3

(58) Field of Classification Search ..... 5/655.3, 5/706, 710, 713
See application file for complete search history.

(56) References Cited

U.S. PATENT DOCUMENTS

| | | | | |
|---|---|---|---|---|
| 4,267,611 | A | 5/1981 | Agulnick | |
| 5,966,762 | A | 10/1999 | Wu | |
| 6,349,439 | B1 * | 2/2002 | Cook et al. | 5/710 |
| 6,711,771 | B2 | 3/2004 | Cook et al. | |
| 7,086,104 | B1 * | 8/2006 | Tsay | 5/655.3 |
| 2002/0016995 | A1 | 2/2002 | Cook et al. | |
| 2004/0128772 | A1 * | 7/2004 | Branson et al. | 5/713 |
| 2006/0117488 | A1 * | 6/2006 | Hung et al. | 5/713 |
| 2006/0200911 | A1 * | 9/2006 | Hsueh | 5/706 |

FOREIGN PATENT DOCUMENTS

GB 2 319 721 A 6/1998

* cited by examiner

*Primary Examiner* — Shane Bomar
*Assistant Examiner* — Gilbert Y Lee
(74) *Attorney, Agent, or Firm* — Craig A. Fieschko, Esq.; DeWitt Ross & Stevens S.C.

(57) ABSTRACT

A pad (10) of interleaving linear cells (2) has loop straps (1) to hold the central section of the cells (2) linearly in parallel with the cell axis (11), whilst the opposite ends (3) of each cell (2) are secured a pre-determined distance (4) off-set from the cell axis (11). The distance (4) can vary along the length of the pad. By fixing of the ends (3) of the cells (2) at a distance (4) away from the cell axis, each end (3) of the cell (2) is pulled away from the centre axis of the cell, the loop straps (1) and the cell (2) become tensioned, preventing the central cell section from moving or rotating. The resulting cell has been seen to dramatically reduce the movement of a user along the pad with improved user comfort and enhanced pressure relief.

21 Claims, 3 Drawing Sheets

INFLATABLE PAD

FIELD OF THE INVENTION

This invention relates to pressure pads, and in particular to alternating pressure pads of the kind used in the prevention and management of decubitous ulcers in bedridden patients.

BACKGROUND OF THE INVENTION

The formation of decubitous ulcers, commonly known as bed sores, results from, amongst other things, the pressure applied to certain portions of the skin of a bedridden patient. It is known to meet the requirement for the prevention and management of decubitous ulcers with an alternating pressure pad comprising two series of inflatable cells which are interleaved, one series within the other, the cells alternately inflated to support a patient at different locations. Typically, inflation and deflation cycles may last from under two minutes for a gentle massaging effect to over twenty minutes.

Typically, large cells have been used in the form of an elongate cylinder extending linearly straight across a pad. However, these pads have experienced problems in that the alternating inflation and deflation of adjacent cells tends to induce movement of the user down the pad, requiring the user to be manually re-positioned by a nurse or carer. This movement is uncomfortable to the user and areas of the body that require pressure relief from a deflated cell are moved onto an inflated cell resulting in reduced pressure relief for the user.

A further disadvantage encountered with such cells is that a user's bony protuberances, for example, their heels can fall inbetween the inflated cells and rest on the support beneath, therefore experiencing the high pressures likely to cause pressure sores. Furthermore, as the support backrest or pillows are raised to support the user in a seated position, the cells have tended to rotate and separate out under the user's sacrum resulting in the user bottoming and resting on the support beneath the pad.

It is known to have non-linear cells, but there is still some movement of the user down the pad and also rotation of the cells during support of the user in the seated position. Furthermore, the non-linear cells are difficult to manufacture with problems of creases within their inner curvature compromising their pressure relief performance.

SUMMARY OF THE INVENTION

The present invention seeks to make improvements.

Accordingly, the present invention provides a pressure pad comprising at least two sets of alternately inflatable cells, the cells extending linearly transversely along the pad and held in place on a pad base by retaining means, characterised in that the retaining means hold the cells in tension across the pad.

By tensioning the cells on the pad, the pad overcomes the problem in prior art alternating linear celled pads, of the cells rotating or moving apart in relation to each other, creating gaps that parts of a user's body could fall through. The tensioned cells also result in reduced movement of the user along the pad thereby increasing user comfort and the pressure relief obtained.

Preferably, the retaining means are releasable. In a preferred embodiment the retaining means secure the opposite ends of each cell at a predetermined distance from the centre linear axis of the cell. More preferably, the retaining means secure the central region of the cells along the centre linear axis of the cell. In the preferred embodiment, the retaining means comprise loop straps fixed to the pad base retaining the central region of each cell and hook type fasteners retaining each opposite end of the cell.

By moving the fixing points of the opposite ends of each cell away from the same centre line as the centre region of the cell held in the loop straps, the loop straps are tensioned. In use, when a user exerts force in lying or sitting upon the cell surface, the cells are not able to move or rotate as with existing prior art pads as the loop straps in their tensioned state have no room to manoeuvre. The resulting cell axis is a curve creating a more stable structure and has been seen to dramatically reduce the movement of a user along the pad with improved user comfort and enhanced pressure relief.

BRIEF DESCRIPTION OF THE DRAWINGS

The invention will now be described by way of example only, with reference to the accompanying figures in which:-

DETAILED DESCRIPTION OF PREFERRED VERSIONS OF THE INVENTION

Figure 1:
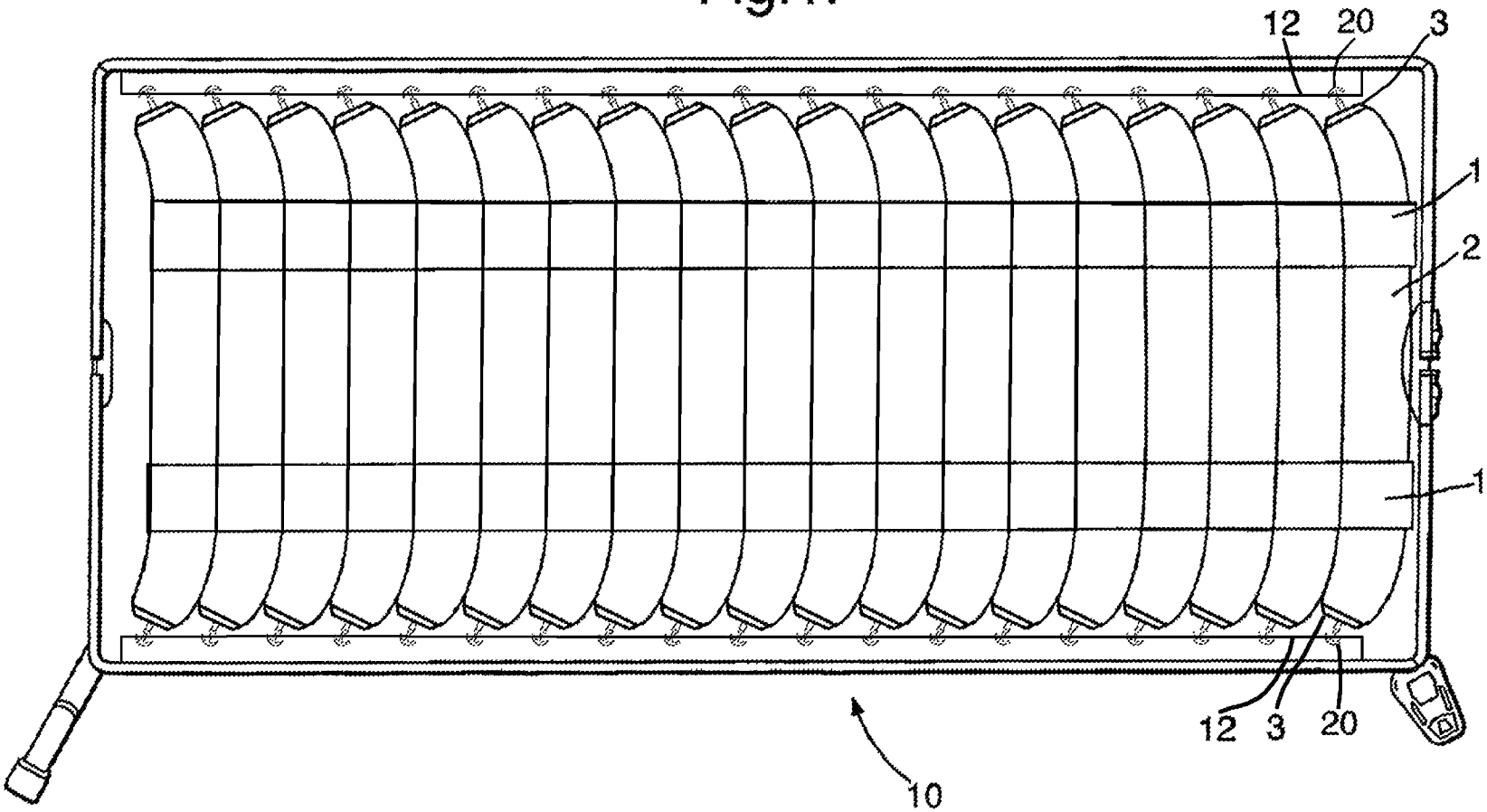
FIG. 1 is a simplified top plan view of a pad according to the invention.
Figure 2:
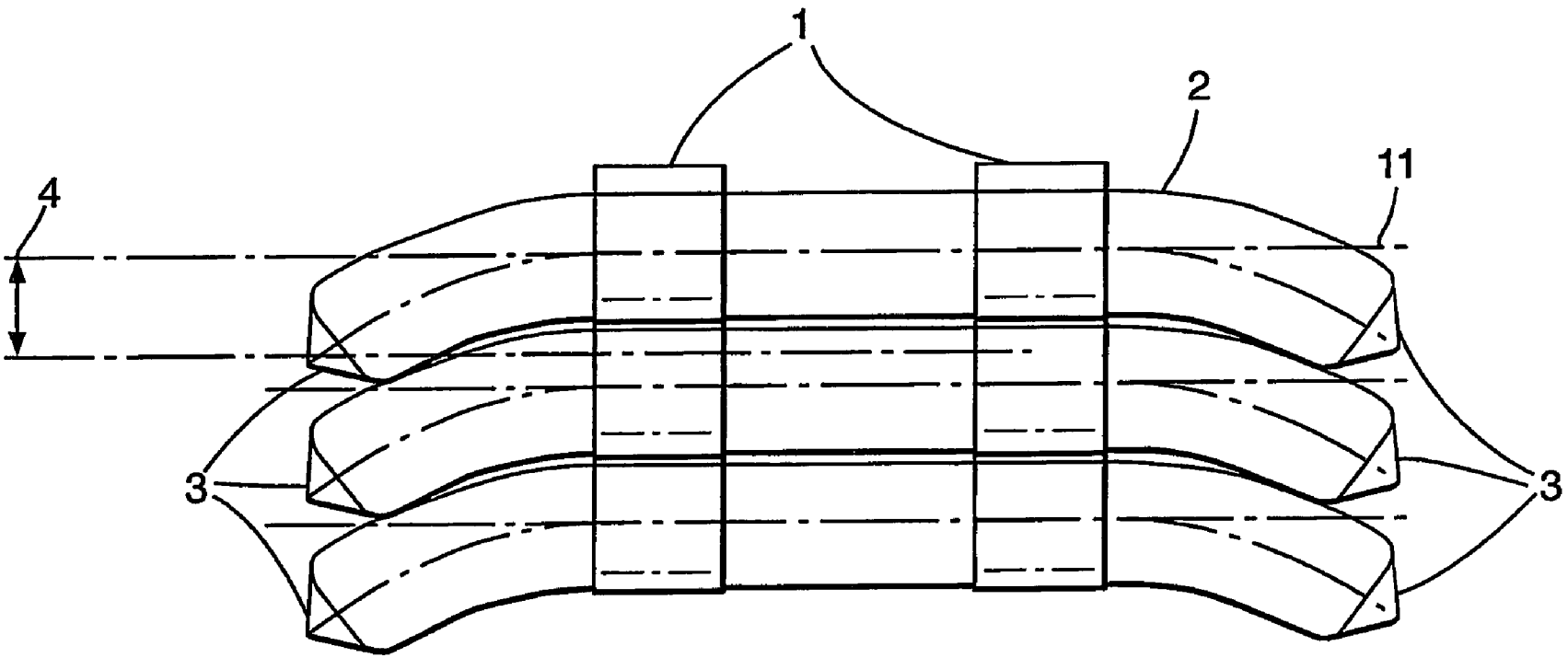
FIG. 2 is a schematic top view conceptually illustrating the bends in the cells 2 of the pad induced by the loop straps 1 and anchored cell ends 3.

FIG. 1 shows a plan view of a pad 10 comprising a bank of interleaving linear cells 2 extending transversely of the pad 10. As shown in FIGS. 1 and 2, loop straps 1 hold the central section of the cells 2 linearly in parallel with the cell axis 11 whereas the opposite ends 3 of the cells 2 are secured a pre-determined distance 4 off-set from the cell axis 11. The distance 4 can vary along the length of the pad.

By fixing of the ends 3 of the cells 2 at a distance 4 away from the cell axis, each end 3 of the cell 2 is pulled away from the centre axis of the cell, the loop straps 1 holding the central section of the cell become tensioned, preventing the central cell section from moving or rotating.

The fact that there is no rotation of the cells is a major advantage because one of the main reasons for the prior art alternating pads inducing downward movement of the user as the cells alternately inflate and deflate, is that with the cell ends anchored on a common linear axis with the loop straps, the loop straps are allowed to pivot about their anchor points and the cells to rotate under a user supported thereupon. These actions act in a similar manner to a conveyor belt. The rising cell supports the user, moves or rotates down the bed, deflates, rises again in its original position and the process continues over and over again.

Moreover, in these prior art alternating pads when a user is positioned in the seated position, a gravitational load is applied to the cells as gravity urges the user down the pad. The resultant movement is uncomfortable to the user and areas of the body that require pressure relief are moved from the deflated cell providing the pressure relief onto an inflated cell with increased contact pressure and resultant compromise in pressure relief.

Figure 3:
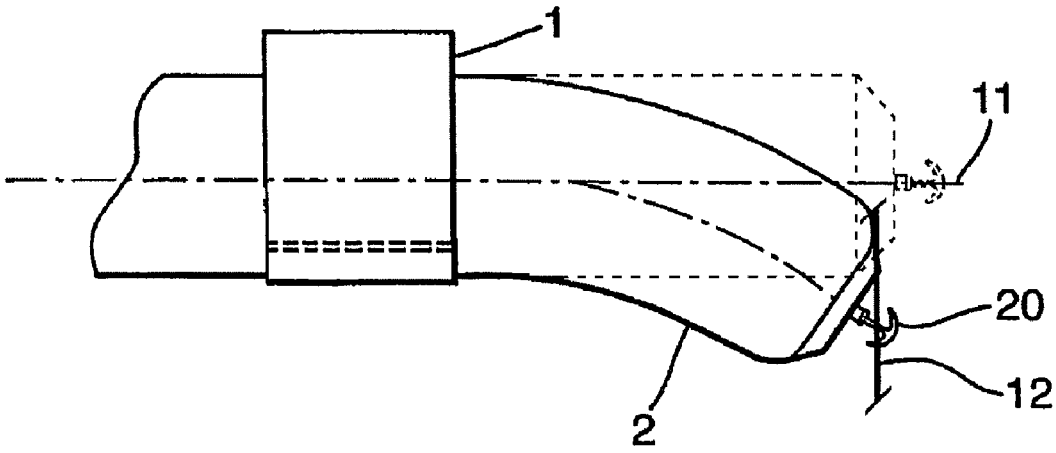
FIG. 3 is a schematic top view conceptually illustrating an end length of a cell 2 within loop strap 1, and the bend induced in the inflated cell 2 when anchor hook 20 (see FIG. 4) secures the cell end to the pad base 12.
Figure 4:
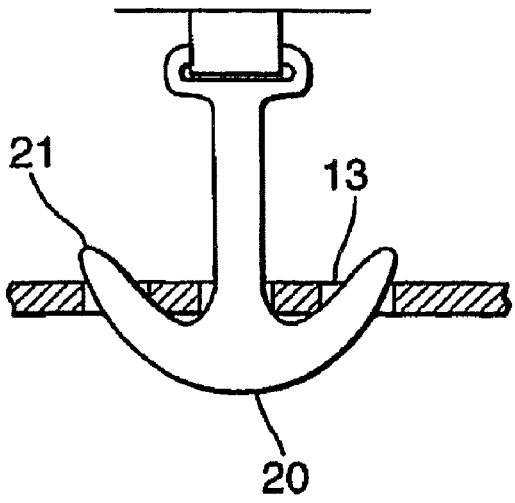
FIG. 4 is a plan view of the anchor hook 20 of FIG. 3.

In a preferred embodiment, each cell end 3 is fitted with a anchor shaped hook 20 which is inserted into a corresponding slot on the pad base 12. (See FIGS. 3 and 4.) The anchor hook 20 is rotated by 90 degrees to align the hook ends 21 with mating apertures 13 within the base 12. The hook ends 21 enter the apertures 13 and secure the cell end 3 to the pad base 12. The cells can be detached from the base 12 by reversing the above procedure.

Although the preferred embodiment describes an anchor shaped hook means for securing the cells to the pad base, other retaining means can be used. For example, press stud fasteners, turn fasteners or similar releasable fasteners can be used to secure the cells in tension in the manner described above.

The invention claimed is:

1. A pressure pad comprising at least two sets of alternately inflatable cells, the cells having lengths extending linearly transversely along the pad and held in place on a pad base by:

a. loop straps fixed to the pad base and retaining the central region of the length of each cell against movement, and b. fasteners releasably retaining the ends of each cell to the pad base at a distance from the central region of the cell, such that each cell is tensioned along the cell's length, with the cell's length being held in a bent state by the loop straps and fasteners with the cell's ends offset from the cell's central region.

2. A pressure pad as claimed in claim 1 wherein the cells are adjacently arrayed such that the bent cells are interfit, with the bend of each cell receiving, and/or being received within, the bend of an adjacent cell.

3. A pressure pad including:

a. a pad base;

b. at least two sets of alternately inflatable cells atop the pad base, the cells having lengths extending between opposing cell ends across the pad base;

c. loops extending about the cells and restraining the cells to the pad base against movement, the loops being spaced from the cell ends; and d. fasteners at the cell ends, the fasteners being affixed to the pad base;

wherein:

(1) the cells are tensioned along their lengths, and (2) the loops and the fasteners bend the lengths of the cells into curved shapes between the loops and the fasteners.

4. The pressure pad of claim 3 wherein the loops extending about one of the cells have central axes which are offset from a linear axis extending between the fasteners of the cell.

5. The pressure pad of claim 3 wherein the loops extending about one of the cells have central axes which are offset from a linear axis extending between the fasteners of the cell, the offset extending in a direction oriented at least substantially perpendicularly to the linear axis extending between the fasteners of the cell.

6. A pressure pad as claimed in claim 3 wherein the bends of the cells receive adjacent cells therein.

7. The pressure pad of claim 3 wherein the bends of the cells rest in a common plane.

8. The pressure pad of claim 3 wherein each cell's length entirely extends between the fasteners at the cell ends, such that the lengths of the cells terminate in the fasteners.

9. A pressure pad including:

a. a pad base;

b. at least two sets of alternately inflatable cells atop the pad base, the cells having lengths extending across the pad base, wherein the lengths of the cells are restrained against movement:

(1) at or near the middles of their lengths by loops extending from the pad base about the cells, and (2) at or near the ends of their lengths, to tension the cells along their lengths, with the lengths of the cells being bent between the middles and ends of their lengths.

10. The pressure pad of claim 9 wherein:

a. the sets of cells have their lengths adjacently arrayed, and b. at least some of the cells have adjacent cells situated within their bends.

11. The pressure pad of claim 9 wherein the bends of the cells rest in a common plane.

12. The pressure pad of claim 9 wherein different cells are bent to different degrees between the middles and ends of their lengths, with the bent cells being oriented along a common plane parallel to the pad base.

13. The pressure pad of claim 9 wherein:

the lengths of the cells are restrained at or near the ends of their lengths by fasteners affixing the cells to the pad base.

14. The pressure pad of claim 9 wherein each cell's length entirely extends between the fasteners at the cell ends, such that the lengths of the cells terminate in the fasteners.

15. A pressure pad including:

a. a pad base;

b. at least two sets of alternately inflatable elongated cells atop the pad base, the cells having lengths extending in tension across the pad base, wherein:

(1) each cell has a central portion spaced from the ends of its length, wherein the central portion:

ii. is restrained against movement to the pad base by a loop extending from the pad base; and iii. is offset from an axis extending between ends of the cell's length, (2) the cells curve along their lengths, and (3) the cells are arrayed in interfitting relationship wherein each cell:

(a) receives an adjacent cell within its curve, and/or (b) is received within the curve of an adjacent cell.

16. The pressure pad of claim 15 wherein a. the cells, when inflated, are restrained to the pad base in the curved shape, and b. the cells, when inflated, assume a different shape when no longer restrained to the pad base.

17. The pressure pad of claim 15 wherein the curves of the cells are aligned along a common plane.

18. The pressure pad of claim 17 wherein the pad base is aligned in a plane parallel to the plane of the curves of the cells.

19. The pressure pad of claim 15 wherein:

a. each cell has a central portion spaced from the ends of its length, and b. the central portion has a central axis offset from a linear axis extending between the ends.

20. The pressure pad of claim 15 wherein the lengths of the cells terminate in fasteners restraining the cells to the pad base, with the lengths of the cells being tensioned between the fasteners.

21. The pressure pad of claim 20 wherein midsections of the cells are restrained to the pad base by loops extending about the cells.

* * * * *